US011747102B2

(12) United States Patent
Zeider et al.

(10) Patent No.: US 11,747,102 B2
(45) Date of Patent: Sep. 5, 2023

(54) INCREASED CAPACITY AMMUNITION MAGAZINE

(71) Applicant: Shield Arms, LLC, Bigfork, MT (US)

(72) Inventors: Brandon Michael Zeider, Bigfork, MT (US); Seth Martin Berglee, Joliet, MT (US); Raymond Dean Brandly, Oklahoma City, OK (US); Cody Blighe Greenfield, Norman, OK (US)

(73) Assignee: Shield Arms, LLC, Bigfork, MT (US)

( * ) Notice: Subject to any disclaimer, the term of this patent is extended or adjusted under 35 U.S.C. 154(b) by 0 days.

(21) Appl. No.: 17/084,057

(22) Filed: Oct. 29, 2020

(65) Prior Publication Data

US 2021/0123698 A1 Apr. 29, 2021

Related U.S. Application Data

(60) Provisional application No. 62/927,158, filed on Oct. 29, 2019.

(51) Int. Cl.
*F41A 9/71* (2006.01)
*F41A 9/69* (2006.01)

(52) U.S. Cl.
CPC .. *F41A 9/71* (2013.01); *F41A 9/69* (2013.01)

(58) Field of Classification Search
CPC ..... F41A 9/61; F41A 9/64; F41A 9/65; F41A 9/69; F41A 9/71
USPC ..... 42/50, 49.01, 6, 7; 89/33.1
See application file for complete search history.

(56) References Cited

U.S. PATENT DOCUMENTS 295,563 A * 3/1884 Lee et al. ..... F41A 9/65 42/50
303,992 A * 8/1884 Diss ..... F41A 9/65 42/50
999,387 A * 8/1911 Mauser ..... F41A 9/65 42/50
1,348,172 A * 8/1920 Hammond ..... F41A 9/65 42/50
1,407,633 A * 2/1922 Burton ..... F41A 9/71 42/50
2,715,290 A * 8/1955 Harvey ..... F41A 17/38 42/50
2,715,789 A * 8/1955 Garand ..... F41A 9/65 42/50

(Continued)

FOREIGN PATENT DOCUMENTS

DE 3422334 A1 * 12/1985 ..... F41A 9/69
EP 0154357 B1 8/1988
WO WO-2019144160 A1 * 7/2019 ..... B29C 45/14

*Primary Examiner* — Jonathan C Weber
(74) *Attorney, Agent, or Firm* — Wood Herron & Evans LLP

(57) ABSTRACT

Provided is an increased capacity firearm ammunition magazine with a metallic body. The body is dimensioned to compatibly replace a (OEM) polymer or polymer over metal single stack magazine. The body has walls with exterior dimensions compatibly matching those of the OEM magazine and that are thinner than those of the OEM magazine. The thinner walls allow an at least partially laterally offset arrangement of cartridges therein. A longitudinal exterior ridge extends along a forward wall of the body and is configured from the metallic body walls and sized to compensate for forward-to-aft dimensioning difference compared to that of the OEM magazine.

8 Claims, 5 Drawing Sheets

(56) References Cited

U.S. PATENT DOCUMENTS 2,777,235 A * 1/1957 Hopkins ..... F41A 9/69 42/50
2,903,809 A * 9/1959 Stoner ..... F41A 9/65 42/50
3,087,270 A * 4/1963 Stoner ..... F42B 39/00 42/50
3,440,751 A * 4/1969 Fremont ..... F41A 9/69 42/50
3,619,929 A * 11/1971 Fremont ..... F41A 9/69 42/50
3,736,686 A * 6/1973 Moller ..... F41A 9/67 42/6
4,589,218 A * 5/1986 Teppa ..... F41A 9/69 42/50
4,638,581 A * 1/1987 Moore ..... F41A 35/06 42/7
4,825,744 A * 5/1989 Glock ..... F41A 5/04 89/145
5,099,595 A * 3/1992 Chesnut ..... F41A 9/69 42/50
5,113,605 A * 5/1992 Kim ..... F41A 9/71 42/50
5,495,687 A * 3/1996 Waiser ..... F41A 9/70 42/50
5,555,661 A * 9/1996 Yap ..... F41A 9/71 42/49.02
5,566,488 A * 10/1996 Yap ..... F41A 9/71 42/49.02
5,704,148 A * 1/1998 Valorose ..... F41A 9/65 42/49.02
5,755,052 A * 5/1998 Keeney ..... F41A 9/65 42/50
5,956,878 A * 9/1999 Yang ..... F41A 9/65 42/50
7,937,872 B1 * 5/2011 Fluhr ..... F41A 9/65 42/50
9,347,721 B2 * 5/2016 Larson, Jr. ..... F41A 9/69
10,619,959 B1 * 4/2020 Loveday, IV ..... F41A 9/72
2012/0124879 A1 * 5/2012 Larue ..... F41A 9/70 42/50
2015/0192377 A1 * 7/2015 Larson, Jr. ..... F41A 9/65 42/50
2017/0051990 A1 * 2/2017 Purkiss ..... F41A 9/65
2018/0202734 A1 * 7/2018 Dowling ..... F41A 9/71
2019/0339035 A1 * 11/2019 Coombs ..... F41A 9/69
2021/0080204 A1 * 3/2021 Yeates ..... B29C 45/14631

* cited by examiner

INCREASED CAPACITY AMMUNITION MAGAZINE

RELATED APPLICATIONS

This application claims priority to U.S. Provisional Patent Application Nos. 62/927,158, filed Oct. 29, 2019, and incorporates the same herein by reference.

TECHNICAL FIELD

The present invention relates to removable ammunition magazines for handguns. More particularly, it relates to a magazine that provides increased capacity over a single stack magazine of similar tube length without increasing its external width and compensating for fore/aft size reduction.

BACKGROUND

Semiautomatic handguns typically use removable ammunition magazines that are insertable into a magazine well formed in the grip of the handgun. These are typically known as "box" magazines and have a tubular body that is substantially rectangular in cross section. A row of ammunition cartridges is aligned within the body and is pushed upwardly by a follower that is biased by a compression spring. The bottom end of the body is closed by a removeable floor plate that retains the spring and provides an end against which the springs bears. At the top end of the body, known as the mouth, an ammunition cartridge is presented and held in position by feed lips. As the slide or bolt face cycles forward, this presented cartridge is stripped from the feed lips and guided into the chamber of the barrel.

The size and shape of these removable handgun magazines vary depending on the model of the handgun, caliber of the ammunition, and number of ammunition cartridges to be held. Some handguns require a specialized magazine that is specific to the handgun's make or model. In other examples, such as the M19111A1, standards have been adopted for a non-proprietary handgun pattern such that ammunition magazines will generally fit and operate in any handgun of that pattern, regardless of the manufacturer.

Some handgun magazines hold rimless cartridges substantially parallel to one another in a single row. These are known as "single stack" magazines. Other magazine designs hold cartridges substantially parallel to each other in an alternating double column. These are known as "double stack" magazines. A double stack magazine will hold more rounds than a single stack magazine of the same length, but is significantly wider. A wider, double stack magazine requires the handgun to have a wider grip, which may be more difficult for a smaller hand to hold and may make the grip of the handgun less concealable under clothing.

The follower in a single stack magazine will typically have a flat top surface that bears against an ammunition cartridge and will be retained by the feed lips when the cartridges have been depleted. A double stack magazine follower is laterally asymmetrical to induce the staggered position of rounds as they are loaded into the magazine. A single round will be centered by the feed lips, even though the force applied by the follower may be off-center because of its laterally asymmetric shape.

The body of most detachable box magazines is made from either metal (such as steel or aluminum), a molded polymer plastic material, or a combination of these materials. Original equipment manufacturer (OEM) magazines made by Glock™ for its handguns have a body made from a combination of materials and may be described as either polymer with a full or partial metal liner, or as a metal body with a polymer jacket. This combination of materials has advantageous qualities, but it results in a relatively thick magazine wall. Some aftermarket magazines for Glock™ handguns are all or mostly polymer. Magazines for most Glock™ handgun models are of the double stack variety. However, Glock™ has designed and sold at least one model (e.g., Glock 43 or 43X) in which the magazine holds cartridges in only a single row (single stack) or in only slightly staggered rows in order to keep the overall thickness of the handgun to a minimum. However, because it does not accept a double stack magazine, the ammunition capacity of this model's single stack magazine is less than that of a double stack magazine of similar length.

If a steel magazine is made to fit in the cross-sectional space designed for a polymer magazine (or in the case of Glock™ OEM magazines, polymer over steel), the increase in interior side-to-side width can allow increased capacity by going from a single stack to a double stack. However, it leaves too much interior room in the front to back (fore/aft) direction. This increased interior front-to-back space is a problem because the rounds can ride too far forward and make contact with the slide stop. Others have filled such extra space with a shim, attached to either the interior or exterior of the forward wall of the magazine tube. However, this approach requires an additional manual step in the manufacturing process, adding cost and weight.

SUMMARY OF THE INVENTION

The present invention provides an ammunition magazine with reduced-thickness metallic body walls, allowing a stack of cartridges to be held substantially parallel to each other with a partial staggering of rounds. This allows more rounds to be held in a magazine of both the same length and width of the prior single stack (or only slightly offset) magazine. A longitudinal ridge is formed in the metallic forward wall of the magazine tube so that the interior surfaces that contact ammunition cartridges remains unchanged and the space is compensated for without using any significant amount of additional material.

The invention provides an increased capacity firearm ammunition magazine with a metallic body. The body is dimensioned to compatibly replace a (OEM) polymer or polymer over metal single stack magazine. The body has walls with exterior dimensions compatibly matching those of the OEM magazine and that are thinner than those of the OEM magazine. The thinner walls allow an at least partially laterally offset arrangement of cartridges therein. A longitudinal exterior ridge extends along a forward wall of the body and is configured from the metallic body walls and sized to compensate for forward-to-aft dimensioning difference compared to that of the OEM magazine.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 3:
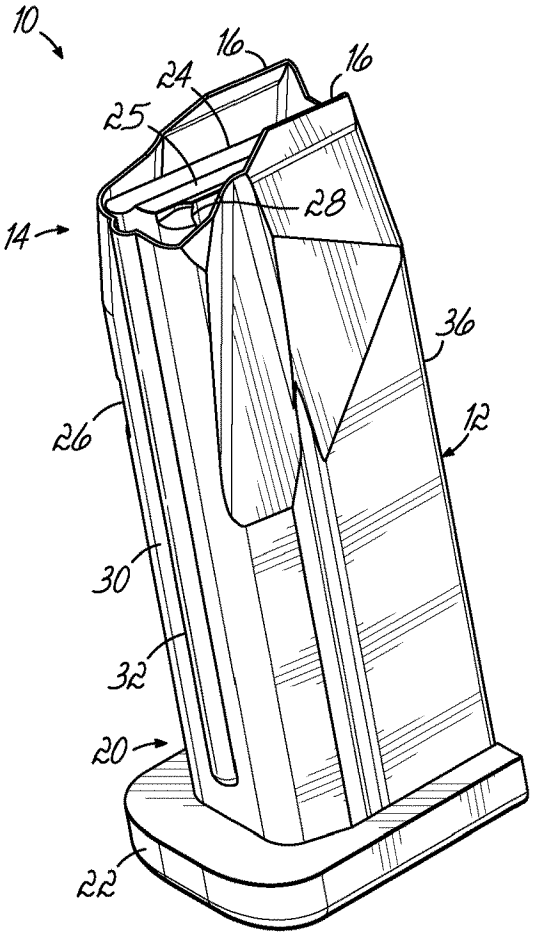
FIG. 3 an isometric view of an increased capacity ammunition magazine according to an embodiment of the present invention empty and with the follower raised.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" indicates the direction of the muzzle and the direction in which projectiles are fired, while "rearward" indicates the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Figure 2:
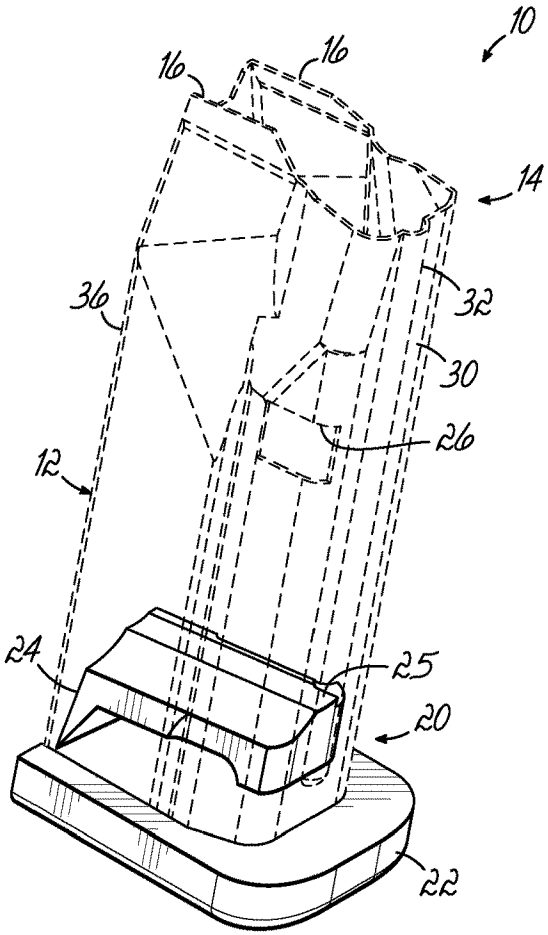
FIG. 2 is a similar thereof with the ammunition cartridges removed.
Figure 1:
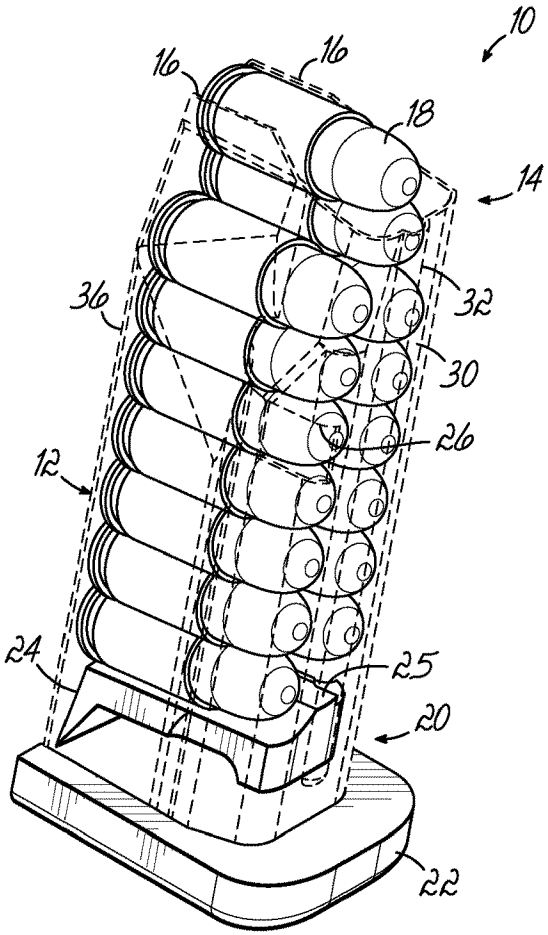
FIG. 1 is a front slightly askew view of a fully loaded, increased capacity ammunition magazine according to an embodiment of the present invention, with the magazine body shown in phantom.
Figure 6:
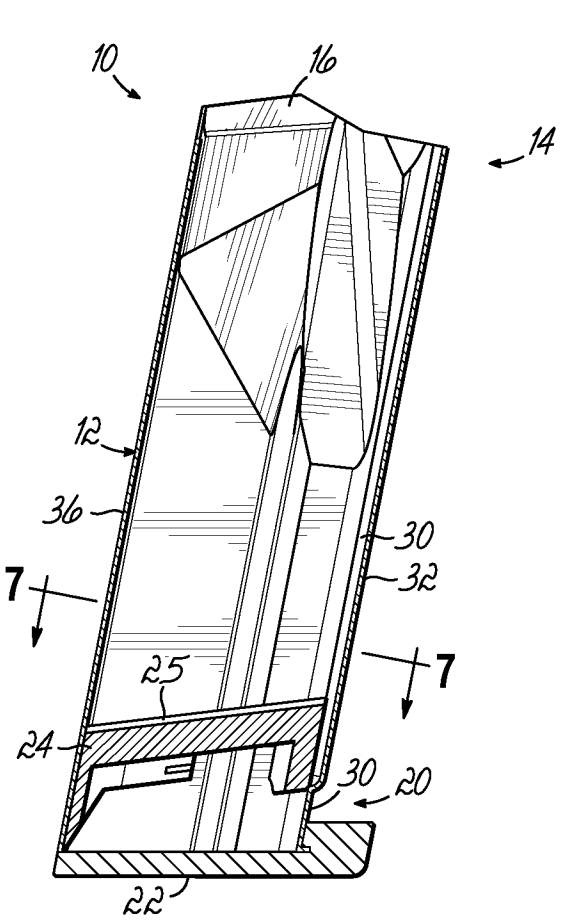
FIG. 6 is a side sectional view with the follower lowered.
Figure 5:
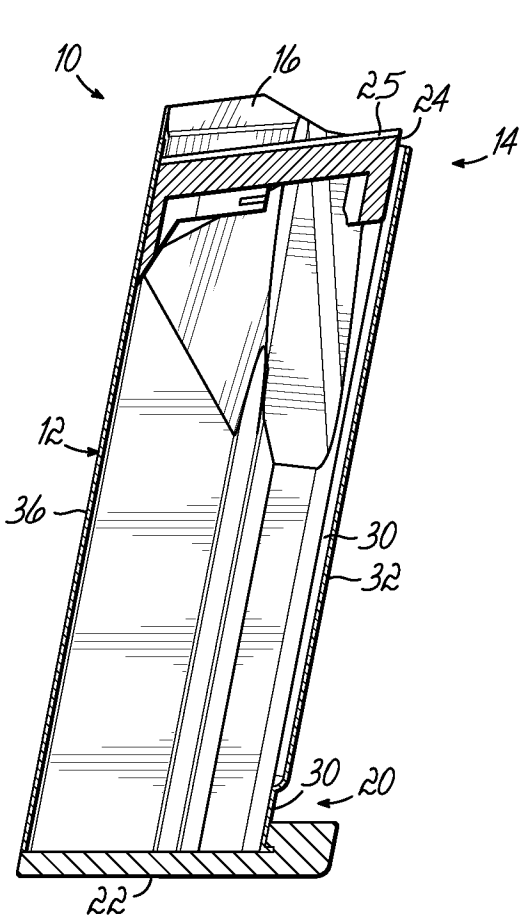
FIG. 5 is a side sectional view with the follower raised to the top.
Figure 4:
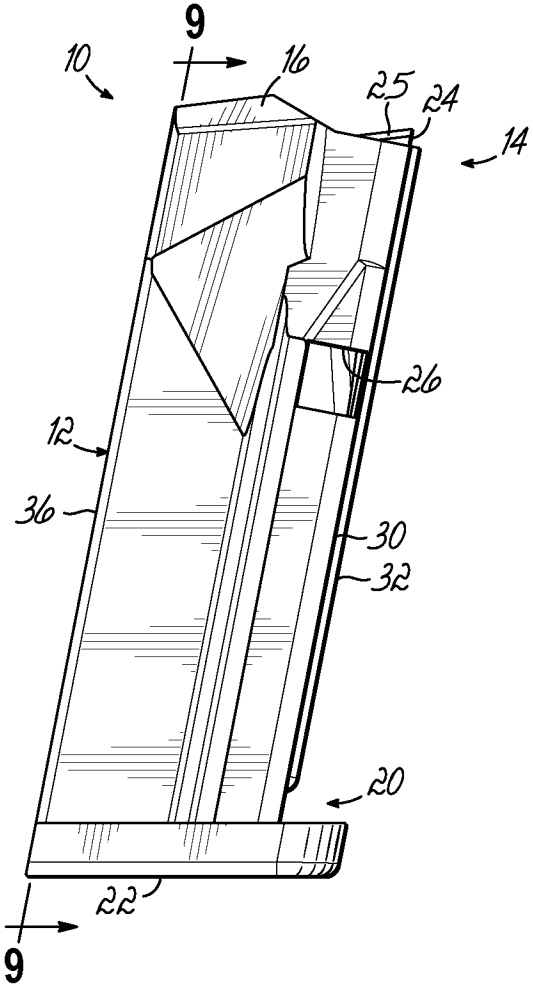
FIG. 4 is a side view thereof.

Referring first to FIGS. 1-4, therein is shown a detachable box magazine 10 for a handgun according to one embodiment of the present invention. the Like other box magazines, it includes a generally tubular body 12 having an open upper end 14 (also known as the "mouth") with feed lips 16 that hold an ammunition cartridge 18 in place for feeding when the magazine 10 is inserted into a firearm. In FIGS. 1 and 2, the tube is shown in phantom so that the cartridges (FIG. 1) and follower 24 can be seen. A bottom end 20 of the body 12 is also open and accepts attachment of a base pad 22 or other removable closure member. According to one aspect of this embodiment, the magazine body 12 is formed of sheet metal material, such as steel, that will provide sufficient strength at a minimum of thickness. Typically, the body 12 is formed by stamping (or roll forming) with a longitudinal seam (not shown). The body 12 may include one or more cut-outs 26 that allow the magazine 10 to be retained by a magazine catch (not shown) in the magazine well of the firearm.

The illustrated embodiment is intended to replace a single stack or only slightly offset type magazine having walls made of a thinker, polymer material, but with corresponding exterior dimensions so that it may be substituted and function otherwise identically in the same firearm. The illustrated magazine 10 is dimensioned for a Glock 43X handgun, which holds 9×19 mm cartridges (also known as 9 mm Parabellum or 9 mm Luger) and replaces a ten-round polymer magazine with one that holds fifteen rounds in the same overall space. The present invention may be adapted to provide increased ammunition capacity replacing a single stack or slightly staggered row polymer magazine for most any caliber or model.

Figure 9:
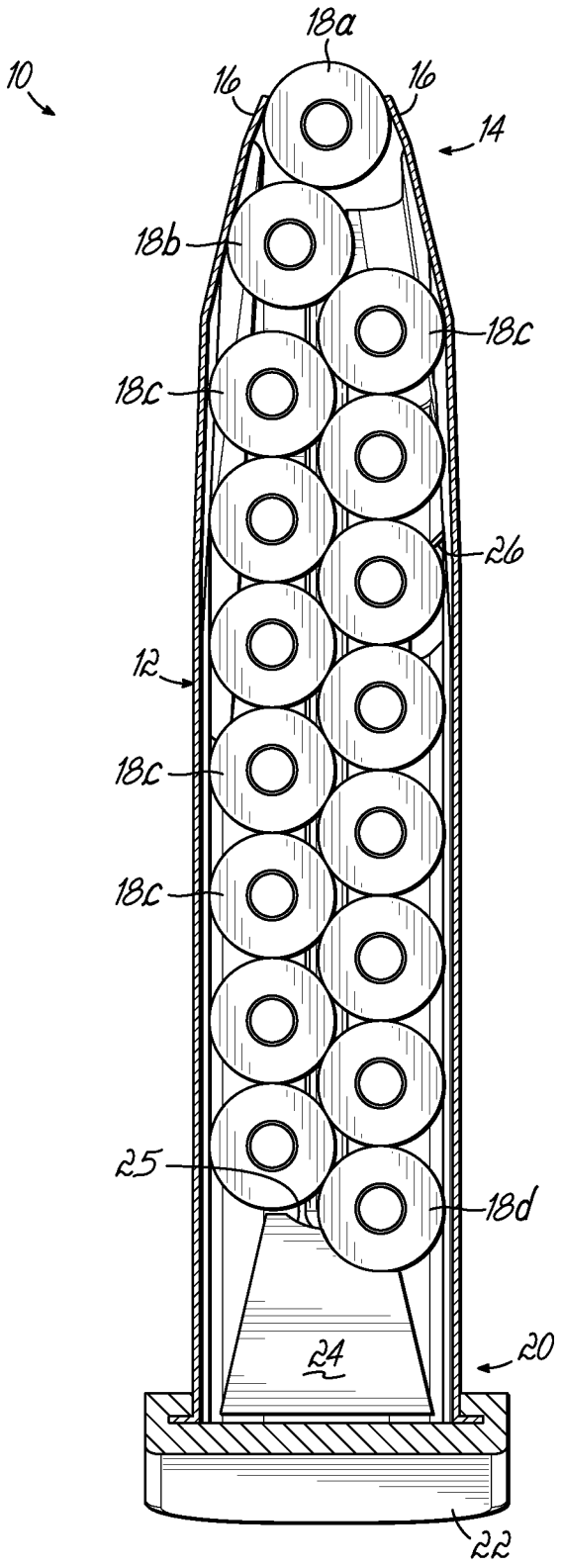
FIG. 9 a rear longitudinal sectional view taken substantially along line 9-9 of FIG. 4 in which the magazine is filled with cartridges.

Referring now also to FIG. 9, the body 14 holds a staggered or laterally offset row of cartridges 18, each situated substantially parallel to each other. At the bottom of the row of cartridges 18 is a follower 24 that is spring-biased toward the upper end 14 of the body 12. For clarity, the well-known compression spring is not shown, but would be compressed within the body 12 between the follower 24 and base pad 22 or other bottom closure member. As is well known, the spring-biased follower 24 will push the row(s) of cartridges 18 toward the upper end 14 and feed lips 16 as cartridges 18 are removed manually, or by cycling of the firearm's bolt/slide.

In a single stack magazine, the follower has a flat, generally laterally symmetric surface that bears against the cartridge. As shown in FIGS. 7-11, the follower 24 is laterally asymmetric so that the cartridge 18*d* against which it bears will be shifted to one side (in the illustrated embodiment, the right side) as additional cartridges 18 are loaded, causing subsequent cartridges 18 loaded into the magazine 10 to position themselves in this staggered or offset alignment. The follower 24 may be hollow and open to the bottom to reduce weight and material and/or to partially receive the internal magazine spring (not shown).

Figure 11:
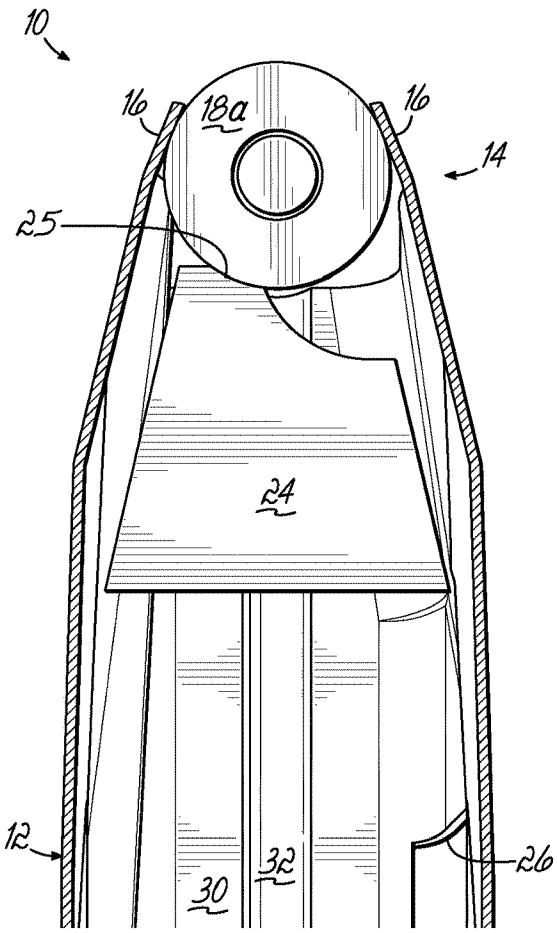
FIG. 11 is a similar rear sectional view with one cartridge remaining.
Figure 10:
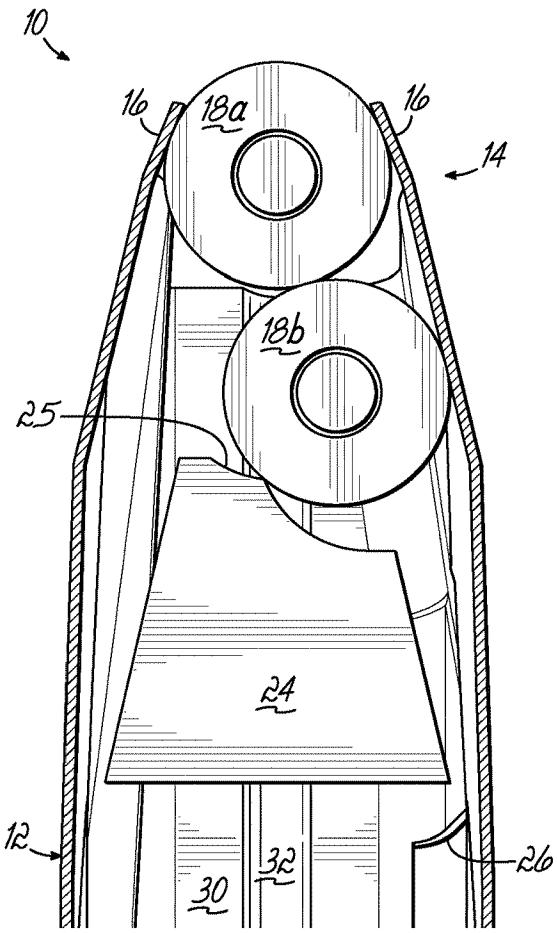
FIG. 10 is an enlarged rear sectional view of the top portion of the magazine with two cartridges remaining.

As shown in FIGS. 9-11, the cartridge 18*a* positioned against the feed lips 16 is substantially centered, the second-in-line cartridge 18*b* rides against an angled wall of the body 12 toward the center, while all of the remaining cartridges 18*c* are in an alternating staggered or at least partially offset positions. Unlike other magazine designs having a neck portion in which at least a second-in-line cartridge is also centered directly below the top cartridge, the present invention maximizes capacity by centering only the top cartridge and partially centering the second-in-line cartridge 18*b*. Magazines with a narrowed neck may also require an elongated follower, which sacrifices capacity. As shown in FIG. 11, when only one cartridge 18*a* remains in the magazine 10, the laterally converging walls at the upper end 14 of the body 12 center the cartridge 18 between the feed lips 16 and the raised platform area 25 of the follower 24 holds it in place.

Figure 12:
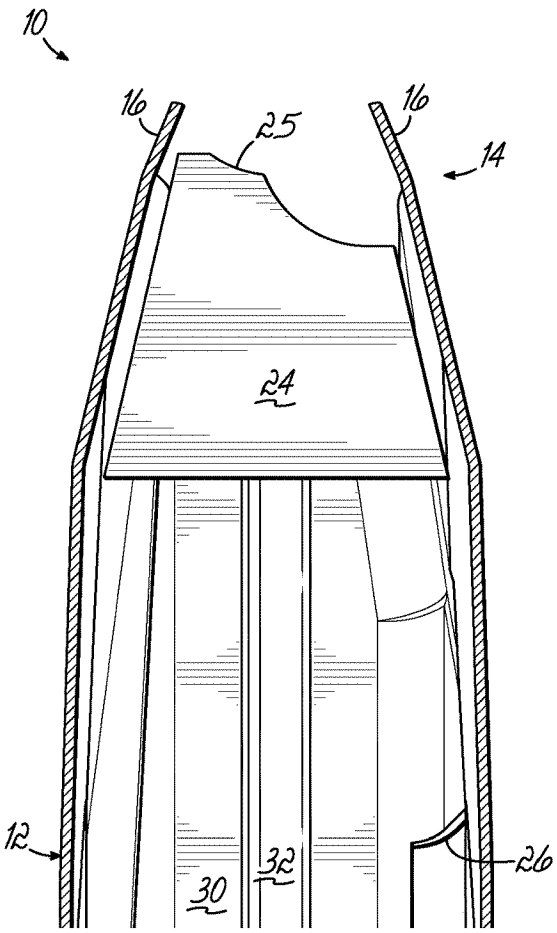
FIG. 12 is a similar rear sectional view with no cartridges remaining.

Referring now also to FIG. 12, when the magazine 10 is empty, the follower 24 seats in the converging upper end 14 of the body 12. A notch 28 at the forward edge of the follower 24 may be provided to engage a slide or bolt catch, causing the action to remain open after the last round is discharged in a well-known manner.

The magazine 10 of the present invention provides increased capacity with a width dimension identical to that of the prior art single stack (or slightly staggered) magazine by utilizing thinner metallic walls that correspond to the exterior dimension of the lower-capacity magazine it replaces and staggering or offsetting all of the cartridges 18 below the upper most round without utilizing a narrowed neck region. The reduction in wall thickness provides the increased interior width needed to accommodate the increased capacity of cartridges, but it creates a problem of too much space in the forward/aft direction. If the cartridges are allowed to shift forward in the magazine tube/body, they will not be positioned to correctly or reliably feed from the lips. If the forward wall is set in to correctly guide the position of the cartridges, then the magazine will fit too loosely in the magazine well of the firearm.

Figure 8:
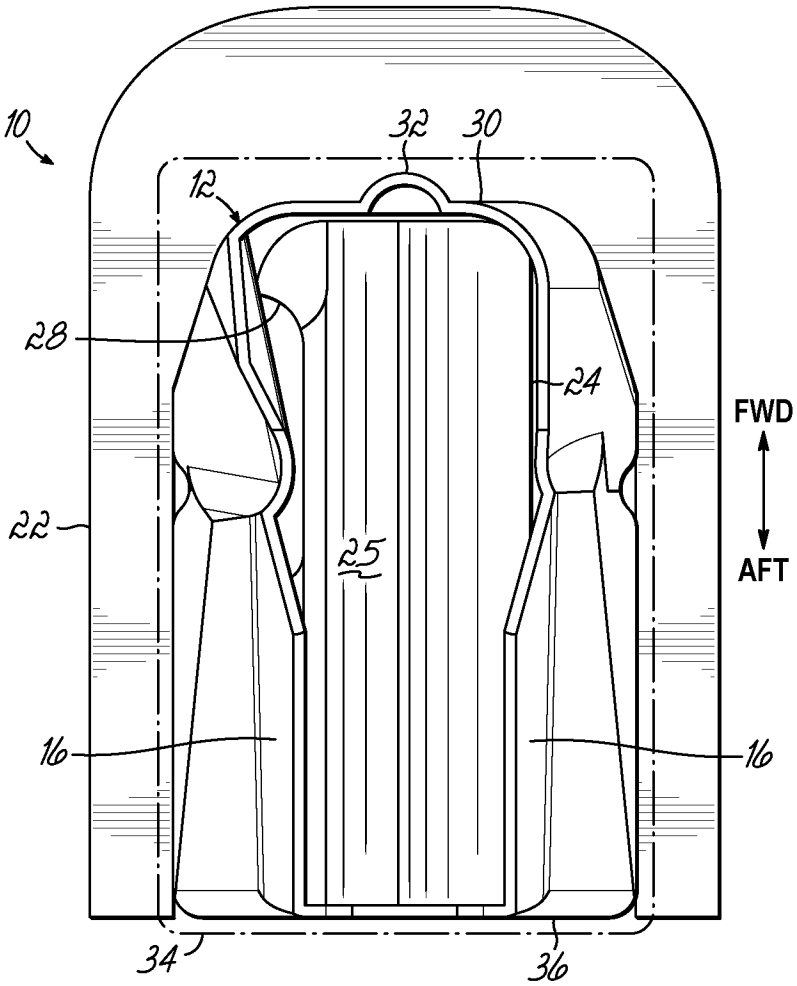
FIG. 8 is a top view taken substantially along line 8-8 of FIG. 5.
Figure 7:
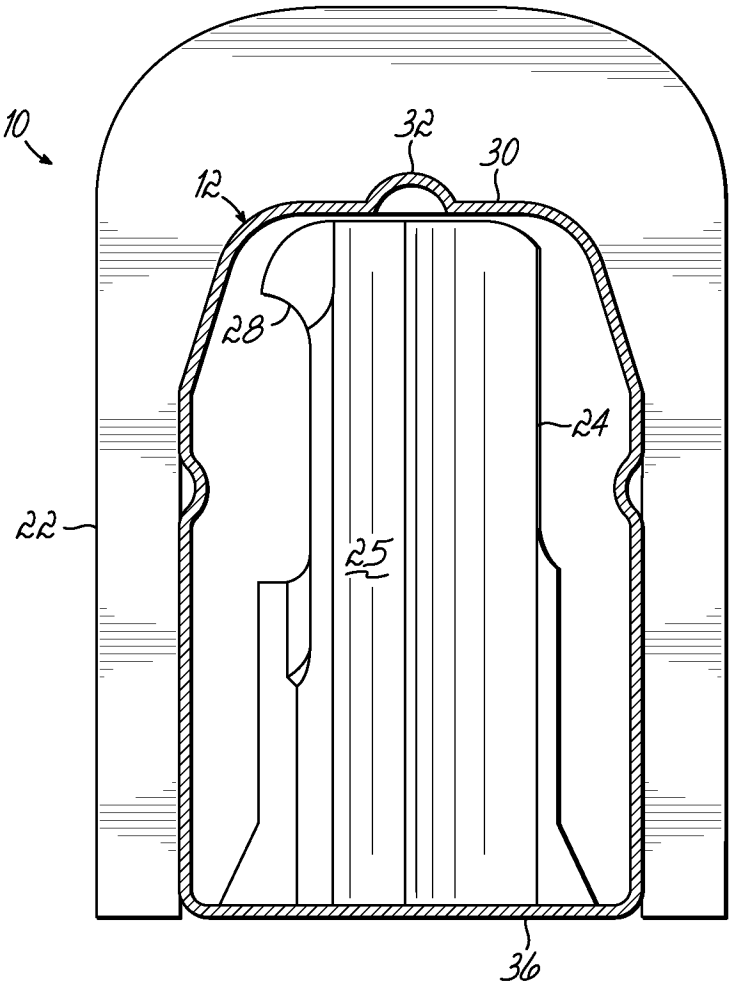
FIG. 7 a cross-sectional view taken substantially along line 7-7 of FIG. 6.

As best seen in FIGS. 3, 7, and 8, according to one embodiment of the invention, a forwardly projecting longitudinal ridge 32 is formed in the forward wall 30 of the metallic body 12. The ridge 32 can be stamped or roll formed into the metal as it is formed into the shape of the body 12. The forward wall 30 is positioned (in the fore/aft direction) to correctly guide the cartridges 18 and follower 24 and the ridge 32 guides the magazine body 12 to be correctly spaced in the magazine well (indicated with dash-dot line 34 in FIG. 8). This laterally centered position of the ridge 32 does not interfere with the feeding of the cartridges 18 or movement of the follower 24. The length of the ridge depends on what is necessary to adequately support the seated magazine 10. In the illustrated embodiment, the ridge 32 extends all the way to the tope end 14 of the body 12, but it stops slightly short of the bottom end 20, where it could interfere with attachment of the base pad 22. If desired, or needed to properly feed, the compensated-for space can be divided between a forward ridge 32 and a ridge (not shown) in the rear wall 36 of the body 12. Also if desired, the bottom end 20 of the body 12 could be shaped to mimic that of the OEM polymer or polymer over metal magazine so that an OEM base plate or extension (not shown) could be used.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A pistol magazine, comprising: a metallic tubular body defining a hollow interior having a forward wall, a rearward wall, a first side wall, a second opposite side wall, an open top with feed lips, and a bottom removable closure member, the forward wall having a longitudinally extending rib formed therein and projecting outwardly therefrom, a cut-out in the first side wall or the second opposite side wall configured to interact with a magazine catch of a polymer frame pistol configured to accommodate a single stack polymer or polymer-over-metal magazine, a first internal dimension between the forward wall and the rearward wall dimensioned to fit 9×19 mm cartridges, a second internal dimension between the first side wall and the second opposite side wall dimensioned to fit 9×19 mm cartridges with a staggered arrangement of the cartridges, the walls having a height dimension configured to fit within a handgrip of the polymer frame pistol with the bottom removable closure member configured to be located directly adjacent to the bottom of the handgrip when the magazine is inserted into the handgrip of the polymer frame pistol, a first external dimension of the metallic tubular body from the forwardmost surface of the longitudinally extending rib to the rearmost surface of the rearward wall to match the corresponding exterior dimension of the single stack polymer or polymer-over-metal magazine, and a second external dimension of the metallic tubular body from the external surface of the first side wall to the external surface of the second opposite side wall to match the corresponding exterior dimension of the single stack polymer or polymer-over-metal magazine.

2. The magazine of claim 1 wherein the magazine has an increased ammunition capacity of at least 50% over and above that of the single stack polymer or polymer-over-metal magazine.

3. The magazine of claim 1 wherein the magazine has an ammunition capacity of fifteen rounds and the single stack polymer or polymer-over-metal magazine has an ammunition capacity of ten rounds.

4. The magazine of claim 1 wherein an upper portion of the metallic tubular body is formed such that a first upper cartridge is centered side-to-side, a third cartridge down from the first cartridge is fully staggered side-to-side, and a second cartridge down from the first cartridge is only partially staggered side-to-side.

5. A pistol magazine, comprising: a metallic tubular body defining a hollow interior having a forward wall, a rearward wall, a first side wall, a second opposite side wall, an open top with feed lips, and a bottom removable closure member, the forward wall having a longitudinally extending spacer projecting outwardly therefrom, an edge in the first side wall or the second opposite side wall configured to interact with a magazine catch of a polymer frame pistol configured to accommodate a single stack polymer or polymer-over-metal magazine, a first internal dimension between the forward wall and the rearward wall dimensioned to fit 9×19 mm cartridges, a second internal dimension between the first side wall and the second opposite side wall dimensioned to fit 9×19 mm cartridges with a staggered arrangement of the cartridges, the walls having a height dimension configured to fit within a handgrip of the polymer frame pistol with the bottom removable closure member configured to be located directly adjacent to the bottom of the handgrip when the magazine is inserted into the handgrip of the polymer frame pistol, a first external dimension of the metallic tubular body from the forwardmost surface of the longitudinally extending spacer to the rearmost surface of the rearward wall to match the corresponding exterior dimension of the single stack polymer or polymer-over-metal magazine, and a second external dimension of the metallic tubular body from the external surface of the first side wall to the external surface of the second opposite side wall to match the corresponding exterior dimension of the single stack polymer or polymer-over-metal magazine.

6. The magazine of claim 5 wherein the magazine has an increased ammunition capacity of at least 50% over and above that of the single stack polymer or polymer-over-metal magazine.

7. The magazine of claim 5 wherein the magazine has an ammunition capacity of fifteen rounds and the single stack polymer or polymer-over-metal magazine has an ammunition capacity of ten rounds.

8. The magazine of claim 5 wherein an upper portion of the metallic tubular body is formed such that a first upper cartridge is centered side-to-side, a third cartridge down from the first cartridge is fully staggered side-to-side, and a second cartridge down from the first cartridge is only partially staggered side-to-side.

* * * * *